US005433401A

United States Patent [19]

Ricketts

[11] Patent Number: 5,433,401

[45] Date of Patent: Jul. 18, 1995

[54] AIRFOIL SHAPED KITE WITH AILERON EXTENSIONS

[76] Inventor: Marc C. Ricketts, 1 School St. #10, Manchester by the Sea, Mass. 01944

[21] Appl. No.: 181,141

[22] Filed: Jan. 12, 1994

[51] Int. Cl.[6] ..... B64C 31/06

[52] U.S. Cl. ..... 244/153 R; 244/155 A; D21/89

[58] Field of Search ..... 244/153 R, 154, 155 A; D21/88, 89

[56] References Cited

U.S. PATENT DOCUMENTS

D. 250,669 12/1978 Wilson ..... 244/153 R 2,134,403 10/1938 Holland, Jr. ..... 244/153 R

*Primary Examiner*—Galen L. Barefoot

*Attorney, Agent, or Firm*—Morgan & Finnegan

[57] ABSTRACT

A stunt kite. The stunt kite includes a kite sail having a center section between a pair of outwardly and upwardly extending aileron sections. The center section has a front edge including first and second forwardly directed tips and a back edge including backwardly directed tips. A support structure is secured to the kite sail to support the center section and the outwardly extending aileron members in the shape of an air foil.

22 Claims, 5 Drawing Sheets

AIRFOIL SHAPED KITE WITH AILERON EXTENSIONS

FIELD OF THE INVENTION

The invention relates to kites, and more particularly, to line control kites that are readily controllable by a user.

BACKGROUND OF THE INVENTION

Flight has fascinated mankind for quite some time. Kites were one of mankind's first attempts to overcome their inability to fly. Since the first kites were developed, many advances have taken place. These advances have led to substantial improvements in the ability to control the movement of kites.

Recent technological advances have brought about a revolution in light weight, high strength materials. These materials have been incorporated into kite manufacture and flight to enable the production of light weight kites that can be readily flown under even negligible wind conditions. Additionally, these technological advances have been incorporated into the development of line control kites, i.e., stunt kites. While having the ability to fly under negligible wind conditions, stunt kites also are capable of performing a wide variety of acrobatic maneuvers when controlled by a skilled flyer.

Stunt kites are controlled by a plurality of relatively short lines that facilitate control over the movement of the air bound kite, whereas conventional kites are generally controlled by a single line retained on a spool that allows the kite to travel as far away as a user is willing to risk.

A stunt kite is disclosed in U.S. Pat. No. 4,736,914 to Tabor. The kite contains a continuous compression support structure. The framework is comprised of continuous compression members (struts) that are rigidly, or semi-rigidly, connected. The continuous use of compression makes them more susceptible to breaking during crashes and large wind loads. Breaking results because the compression structures only have the ability to relieve stress through bending, thereby focusing the stress on bending members which will normally break under such circumstances.

Other stunt kites have increased weight due to the use of heavy gauge rubber and metal connectors to join spars in continuous compression. Some kites utilize dacron pockets running continuously along the leading edge of the kite sails to attach the kite sail to the support spars. This adds undesirable weight to the kite.

In addition to reducing the weight of a stunt kite to its minimum, the kite must be designed to enable a user to readily and reliably control the kite under all weather and wind conditions. Two types of four line control are known in the prior art. The first provides independent wing control. As a result, a user can readily lose control of the kite when either wing is over controlled.

For example, U.S. Pat. No. 5,120,006 to Hadzicki discloses a kite flying device having independent controls for the left and right wings. As the various embodiments disclosed in the patent show, the kite may be controlled by two, four or six hand controlled lines. Additionally, the sheet and struts which make up the kite are manufactured from low weight high strength materials which improve the strength to weight ratio required for optimizing the functional ability of stunt kites.

Similar independent wing control kites are disclosed by Tabor, U.S. Pat. No. 4,892,272 to Hadzicki, U.S. Pat. No. 4,981,273 to Petteys, U.S. Pat. No. 4,958,787 to Sterling.

A second type of control assembly utilizes a wind inflated air foil. These kites contain many panels and bridal lines, and, consequently, can be very difficult to manufacture. If the bridal lines are not perfectly correct in size, the kite will not be able to fly properly.

However, despite the prior art attempts to develop "controllable" kites, prior art kites fail to provide the control necessary to permit a skilled flyer to optimally control the kite through intricate maneuvers, while also allowing novice flyers to use the kite without getting frustrated before they begin to master the controlled movement of the kite. The present invention overcomes the disadvantages of the prior art kites.

SUMMARY OF THE INVENTION

An object of the invention is, therefore, to provide a kite permitting a skilled flyer to optimally control the kite through intricate maneuvers, while also allowing novice flyers to use the kite without getting frustrated before they begin to master the controlled movement of the kite.

Another object of the invention is to provide stronger and more durable stunt kites.

A further object of the invention is to provide a kite with a support structure that disperses its stress and load equally through all of its parts.

Another object of the invention is to provide a kite which has a low size to strength ratio.

An object of the invention is also to provide a flying device which has a high lift to drag ratio through a tension suspended sail having an airfoil shape.

An object of the invention is to provide a kite having a flexible wing that is controlled by four lines.

A further object of the invention is to provide a kite that cannot be over controlled or pulled out of the air.

Another object of the invention is to provide a kite which is easy to launch.

An object of the invention is also to provide a kite that can be flown under all wind conditions.

An additional object of the invention is the provision of a kite which responds to standard four-line and two-line signals from the flyer.

A further object of the invention is to provide a kite with the ability to move three-dimensionally by twisting and/or spiralling around its core, as opposed to the limited ability to create pathways in the air in a two-dimensional plane.

Another object of the invention is to provide a kite having optimum three-dimensional symmetry.

These and other objects of the invention are accomplished by the present stunt kite. The stunt kite includes a kite sail having a center section that is located between a pair of outwardly extending aileron or wing sections. The term aileron is used throughout the description of the present invention to distinguish between the outwardly extending aileron sections and the complete kite which is considered a wing itself. The center section has a front edge including first and second forwardly directed tips and a back edge including backwardly directed tips. A support structure is secured to the kite sail to support the center section and the outwardly extending ailerons in the shape of an air foil.

It is understood that the present kite is intended to change its spatial orientation while it is in flight. With this in mind, the present kite has been described in this application based upon a presumed resting position. Consequently, descriptive spatial terms, such as, forward, backward, horizontal, upward, etc., are intended to be considered with reference to the presumed resting position of the kite. These terms have been used to facilitate a full disclosure of the present invention and should not be understood to limit the spatial orientation of the kite.

Other objects, advantages and salient features of the invention will become apparent from the following detailed description, which, taken in conjunction with the annexed drawings, discloses the preferred embodiments of the subject invention.

FIG. *7a* is a top view of the support structure without the kite sail secured thereto.

FIG. *7b* is a front view of the support structure without the kite sail secured thereto.

FIG. *7c* is a bottom view of the support structure without the kite sail secured thereto.

DETAILED DESCRIPTION OF THE INVENTION

Figure 1:
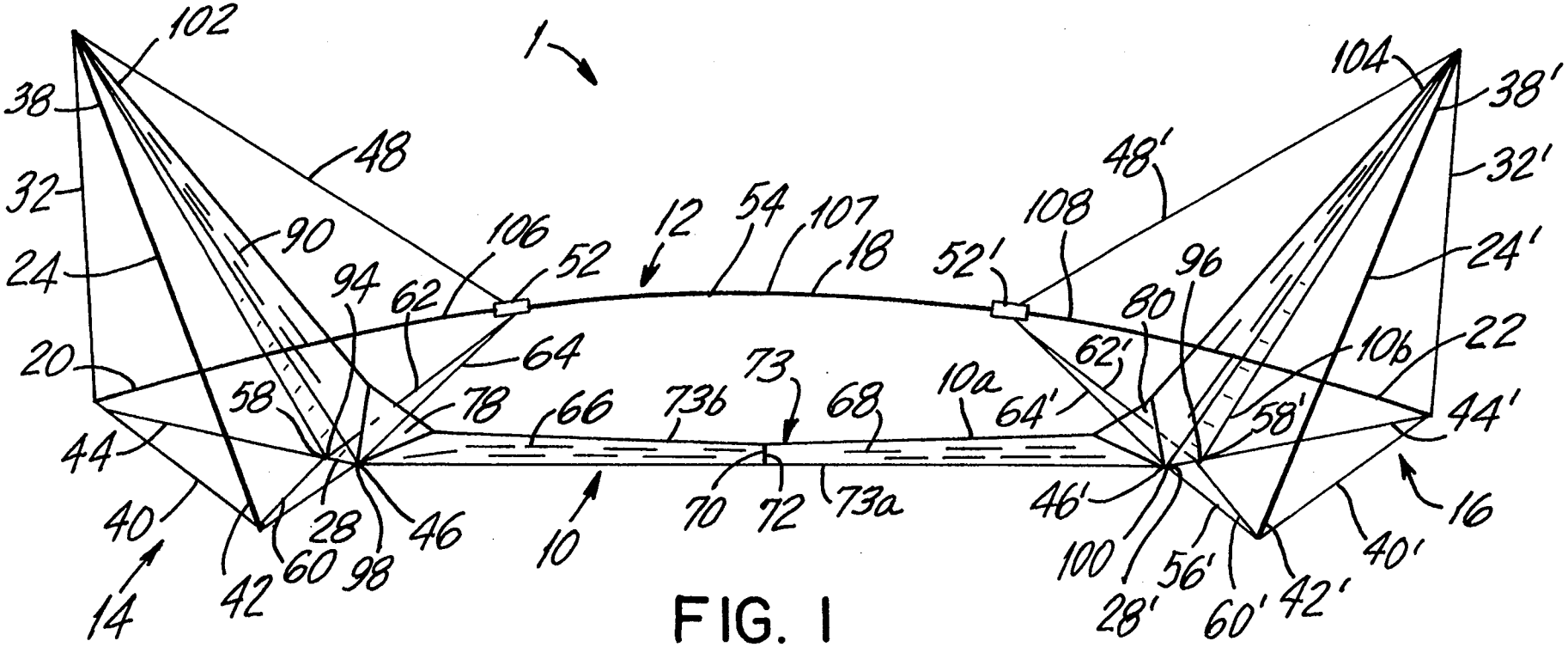
FIG. 1 is a front plan view of the kite in a presumed resting perspective.
Figure 2:
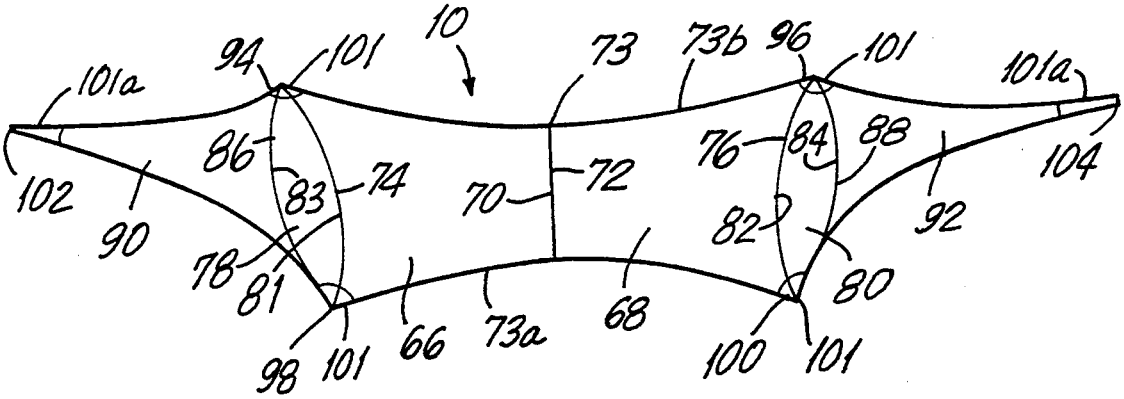
FIG. 2 is a top view of the unsupported kite sail.
Figure 3:
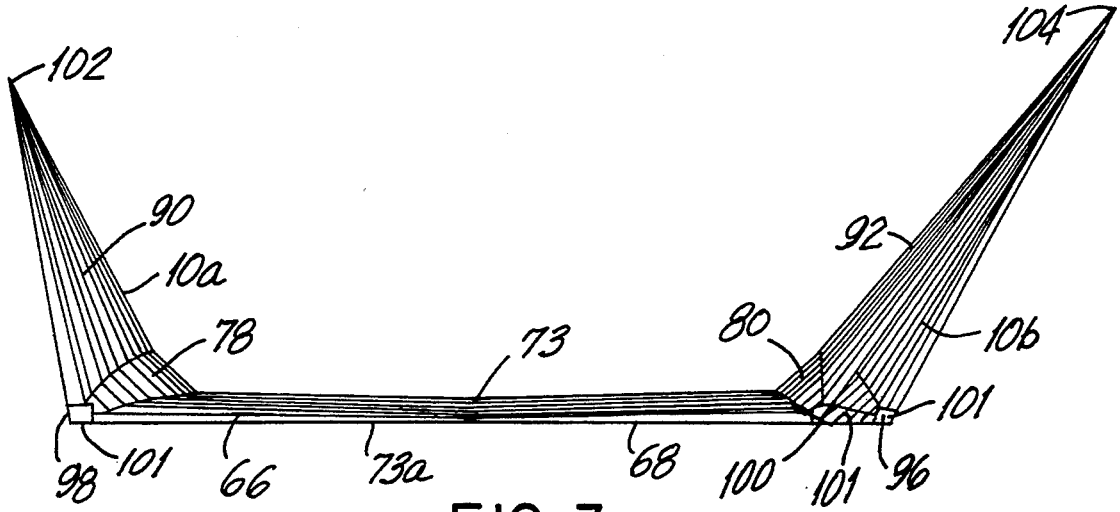
FIG. 3 is a front perspective view of the supported kite without the associated supported structure.

Referring to FIG. 1, the present kite 1 includes a kite sail 10 held in the shape of an air foil by a support structure 12. Preferably, the sail 10 is constructed from a ripstop polyester or nylon, and includes a top surface 10*a* and a bottom surface 10*b*. However, other materials may be used in accordance with the subject invention.

The support structure 12 can be viewed as first and second mirror image sections 14, 16 connected through a cross bow 18. The cross bow 18 pushes outwardly to help create the span of the dynamic support structure 12. Additionally, the cross bow 18 extends along both the top surface 10*a* and bottom surface 10*b* of the kite sail 10. Specifically, the support structure is statically indeterminate, i.e., it is never static. The components of the support structure 12 are dynamic, in a constant flux between stable and mobile.

A first end 20 and second end 22 of the cross bow are secured to upwardly and outwardly extending first spars 24, 24' and horizontally extending second spars 28, 28' and through tip attachments 31 (see FIG. 6) secured to a series of tension lines that will be discussed in more detail below. In fact, all tension lines are secured to the ends of the cross bow 18 and the spars via tip attachments 31 releasably secured at the ends of the respective members. However, the tension lines may be directly secured to the spars, the tip attachments may be permanently secured to the spars, or a variety of other attachment mechanisms may be used within the spirit of the present invention. In the preferred embodiment, substantially all forces passing through the structural members pass through the tip attachments 31. The tip attachments 31 utilized in accordance with the preferred embodiment are described in substantial detail by Hadzicki in U.S. Pat. Nos. 4,892,272 and 5,120,006.

In the preferred embodiment of the present invention, the spars and the cross bow are graphite tubing, although the spars could be manufactured from lightweight aluminum, aluminumcarbide composites, carbon composites, fiberglass composites, plastics or wood. Additionally, the tension lines are preferably Kevlar fiber, Dacron fiber, a polyester synthetic fiber,or other high strength line materials.

As stated above, the support structure 12 can be viewed as first and second mirror images 14, 16 connected by the cross bow 18. As such, the support structure 12 adjacent the first end of the cross bow 12, i.e., the first mirror image section 14, will be described in detail below, while keeping in mind that the support structure 12 adjacent the second end 22 of the cross bow 18 is simply a mirror image of the structure that will be described below. As a result, structural elements of the second mirror section 16 will be designated by "'" where the elements are structurally equivalent to the structure of the first mirror section 14.

Figure 4:
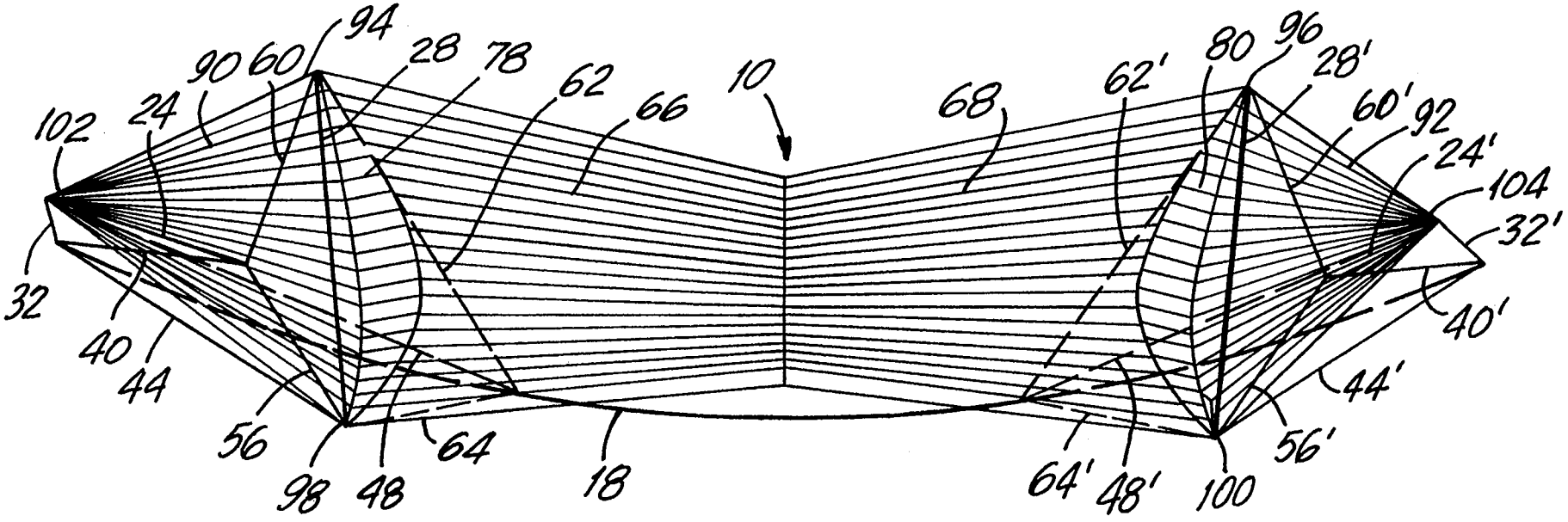
FIG. 4 is a bottom view of the kite.
Figure 5:
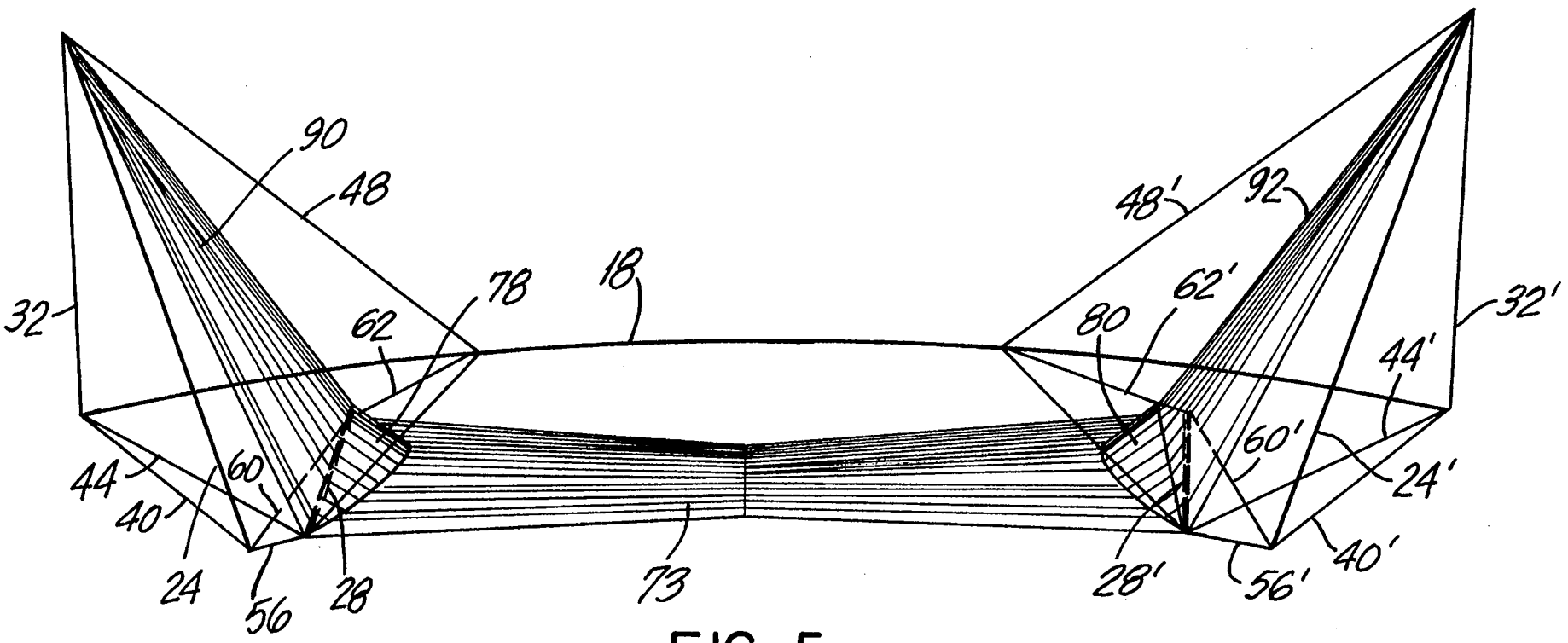
FIG. 5 is a front perspective view of the kite.

Specifically, with reference to FIGS. 1, 4, 5, *7a*, *7b*, and *7c*, tension line 32 is connected between the first end 20 of the cross bow 18 and the first end 38 of the first spar 24. Tension line 32 transfers outward forces to respectively hold the first end 38 of the first spar 24 outwardly and forwardly directed. Tension line 40 is connected between the first end 20 of the cross bow 18 and the second end 42 of the first spar 24. Tension line 40 transfers the outward forces of the cross bow 18 to the first spar 24. Additionally, tension line 44 is connected between the first end 20 of the cross bow 18 and the front end 46 of the second spar 28. Tension line 44 transfers the outward force of the cross bow 18 to pull the front end 46 of the second spar 28 toward the sides of the kite 1.

The first spar 24 directs forces substantially upwardly and downwardly through tip attachments 31 that are respectively releasably secured to the first end 38 and second end 42 of the first spar 24. Briefly, the first end 38 is connected to tension lines 32, 48 and 50. The attachment and function of tension line 32 has been discussed above, and will therefore not be presented again at this time.

As to the remaining structure, tension line 48 is connected between the first end 38 of the first spar 24 and a first hold back 52 located centrally on the cross bow 18. The first hold back 52 is located substantially between the first end 20 and the center 54 of the cross bow 18. Tension line 48 pulls the first end 38 of the first spar 24 downwardly toward the center 54 of the support structure 12. Similarly, tension line 48 pulls upwardly and outwardly on the cross bow 18 through the first hold back 52.

Tension line 50 is secured between the first end 38 of the first spar 42 and the back end 58 of the second spar 28. The tension line 50 pulls downwardly, backwardly and inwardly on the first end 38 of the first spar 24, while the oppose force is applied to the back end 58 of the second spar 28.

As to the second end 42 of the first spar 24, tension lines 40, 56, and 60 are secured thereto. Specifically, tension line 40 is secured between the first end 20 of the cross bow 18 and the second end 42 of the first spar 24. The tension line 40 pulls upwardly and outwardly toward the sides on the second end 42 of the first spar 24. Similarly, tension line 40 pulls downwardly and inwardly on the first end 20 of the cross bow 18

Additionally, tension line 56 is connected between the second end 42 of the first spar 24 and the front end 46 of the second spar 28. The tension line 56 pulls upwardly and forward on the second end 42 of the first spar 24. Tension line 56 also pulls downwardly and forwardly on the front end 46 of the second spar 28.

Tension line 60 is connected between the second end of the first strut and back end 58 of the second spar 28. The tension line 60 pulls upwardly and backwardly on the second end 42 of the first spar 24, while pulling downwardly and forwardly on the back end 58 of the second spar 28.

The second spar 28 pushes outwardly on the front and back of the kite sail 10. The back end 58 of second spar 28 that is connected to tension lines 50, 60, 62. Tension line 50 is located between the back end 58 of the second spar 28 and the first end 38 of the first spar 24. The tension line 50 pulls upwardly and outwardly on the back end 58 of second spar 28, and downwardly and toward the center of the kite 1 on the first spar 24 through the tip attachment 31. Tension line 60 is located between back end 58 of the second spar 28 and the second end 42 of the first spar 24. The tension line 60 pulls downwardly toward the kite's center on the back end 58 of the second spar 28. Likewise, tension line 60 pulls upwardly and forwardly on the first spar 28 through the second end 42.

Additionally, tension line 62 is connected between the back end 58 of the second spar 28 and the first hold back 52 of the cross bow 18. The tension line 62 pulls upwardly and towards the center on the back end 58 of the second spar 28 and downwardly and backwardly on the first hold back 52 of the cross bow 18.

A tip attachment 31 is also releasably secured to the front end 46 of the second spar 28. The tip attachment secures tension lines 44, 56, 64 to the front end 46 of the first spar 24. The tension lines 44, 56, 64 pull inwardly in response to the outward pushing of the second spar 28. Specifically, tension line 44 is mounted between the front end 46 of the second spar 28 and the first end 20 of the cross bow 18. Tension line 44 pulls outwardly and backwardly on the front end 46 of the second spar 28 inwardly and forwardly on the first end 20 of cross bow 18. Tension line 56 is secured between the front end 46 of the second spar 28 and the second end 42 of the first spar 24. The tension line 56 pulls downwardly and backwardly on the front end 46 of the second spar 28 through the tip attachment 31. Likewise, the tension line 56 pulls upwardly and forwardly on the second end 42 of the first spar 24 through the tip attachment 31. Additionally, tension line 64 is connected between the front end 46 of the second spar 28 and the first hold back 52 of the cross bow 18. The tension line 64 pulls inwardly and backwardly on the front end 46 of the second spar 28 and outwardly and downwardly on the first hold back 52 of the cross bow 18.

As to the first and second hold backs 52, 52' of the cross bow 18, they brace the cross bow 18 and the split of the forces acting upon the cross bow into separate sections. The first and second hold backs 52, 52' are ring like members secured around the cross bow 18. The hold backs include a grooved portion which facilitates the attachment of the tension lines thereto. Preferably, the hold backs 52, 52' are washers of high density polypropylene that have been glued to the cross bow 18 at appropriate locations.

When the kite is fully assembled, each of the spars push out as the tensile network pulls in. The tensile network also transfers and disperses the load instantaneously to all members without the multiplication of the bending moment, thus, creating a kite more resilient to crashes and/or high wind loads.

With reference to FIGS. 1, 2, 3, 4, and 5, the sail 10 is made of six panels. All of the panels are preferably sewn together by either polyester thread, nylon thread, or monofilament thread. First and second main center sail panels 66, 68 are connected together along their central edges 70, 72 to form a main center sail 73. The center sail 73 includes a concave front edge **73*a* and a concave back edge 73*b***.

Each of the main center sail panels 66, 68 include a concave outer edge 74, 76, respectively. A first shape control mid-panel 78 is secured to the outer edge 74 of the first main center sail panel 66 and, similarly, a second control mid-panel 80 is secured to the outer edge 76 of the second main center sail panel 68. The shape control mid-panels 78, 80 are substantially shell shaped with convex inner edges 81, 82, and convex outer edges 83, 84. The outer edges 83, 84, are respectively connected to first edges 86, 88 of the first and second aileron panels 90, 92. When assembled the first and second aileron panel 90, 92 extend upwardly and outwardly from the main center sail 73 (see FIG. 3).

As a result of the sail assembly, a first rearward tip 94 is located at the back meeting point of the first main center sail panel 66, the first mid-panel 78, and the first aileron panel 90, while a second rearward tip 96 is located at the back meeting point of the second main center sail panel 68, the second mid-panel 80, and the second aileron panel 92.

Additionally a first forward tip 98 is located at the front meeting point of the first main center sail panel 66, the first mid-panel 78, and the first aileron panel 90, while a second forward tip 100 is located at the front meeting point of the second main center sail panel 68, the second mid-panel 80, and the second aileron panel 92.

The front and rear tips add to the control provided by the present kite. Aerodynamics are also improved by positioning the first and second rearward tips 94, 96 further apart than the first and second forward tips 98, 100.

In addition to the first and second front and rear tips, the kite sail 10 includes first and second outer tips 102, 104 located at the outer ends of the first and second aileron panels 90, 92. Each of the tips 100, 102 are reinforced for attachment to the support structure 12 in a manner that will be subsequently discussed.

Figure 6:
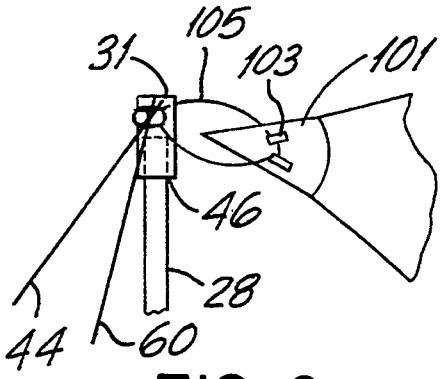
FIG. 6 is an enlarged view of the front end of the second spar.
Figure 7A:
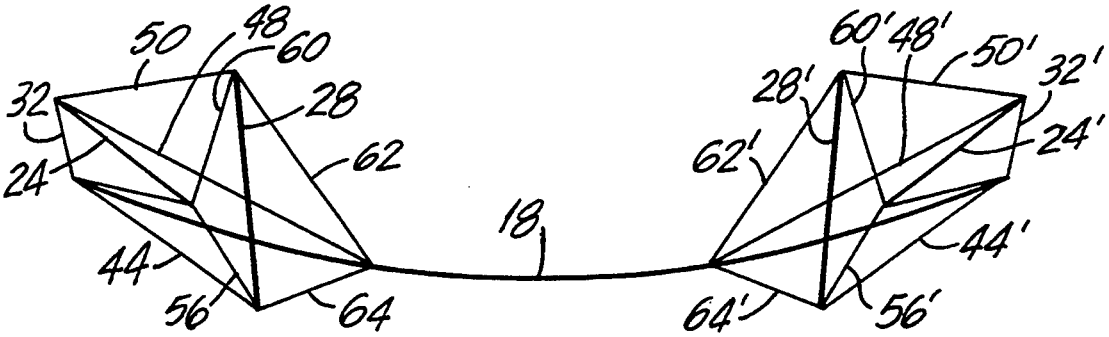
Figure 7B:
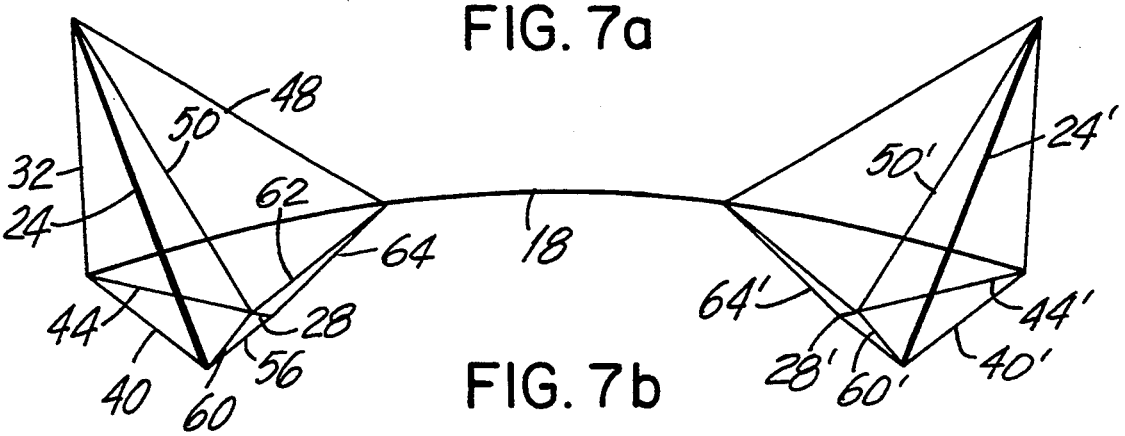
Figure 7C:
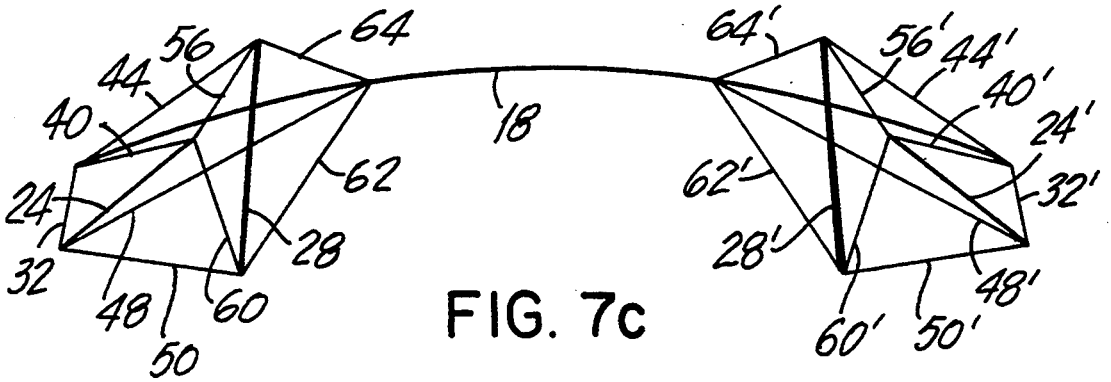

The forward and rearward tips 94, 96, 98, 100 include dacron reinforcements 101 for the attachment of the sail to the second spars 28, 28' of the support structure 12 (see FIG. 6). The reinforcements 101 at the forward and rearward tips have button holes 103 through which tension attachments 105 are threaded. Although the button holes 103 provides the lowest weight to strength ratio, other securing devices, such as grommets, etc., could be used instead of the button holes. The tension attachments 105 are secured to the tip attachments 31 of the second spars 28, 28' in the following manner. The tension attachment 105 on the first rearward tip 94 is secured to the tip attachment 31 of the back end 58 of the second spar 28 and the tension attachment 105 on the second rearward tip 96 is secured to the tip attachment 31 of the back end 58' of the fourth spar 30. Additionally, the tension attachment 105 on the first forward tip 98 is secured to the tip attachment 31 of the front end 46 of the second spar 28 and the tension attachment 105 on the second forward tip 100 is secured to the tip attachment of the front end 46' of the fourth spar 30.

Aileron reinforcements 101a are also attached to the first and second aileron tips 102, 104. These aileron reinforcements are folded over and sewn to create loops through which tension attachments are secured to the aileron reinforcements (not shown). The tension attachments are respectively secured to the tip attachments 31 located on the first ends 38, 38' of the first spars 24, 24'.

When the kite sail 10 is stretched onto the support structure 12 in the manner outlined above, an airfoil shape is created. The airfoil shape is created by the support structure pulling on the kite sail at first ends 38, 38' of the first spars 24, 24' as well as pulling down on the sail at the ends of the second spars 28, 28'. The tailored pattern of the kite sail 10, in combination with the directional pull of the support structure 12, create an arch in the shape control mid-panels 78, 80 which effects the shape of the main center sail 73 to create an airfoil.

In use, flight control is accomplished by two sets of dual line controllers. Each dual line controller includes a pair of flying lines secured at the top and bottom of a handle. The flying lines are attached to controller attachment loops attached to tip attachments 31 on the first and second ends of the second spars. The controller attachment loops facilitate the simple attachment and removal of the flying lines from the kite.

Specifically, first and second flying lines are secured to the tops of the handles and third and fourth flying lines are secured to the bottom of the handles. This situation of top and bottom, can be reversed if flyer chooses. When the orientation of the flying lines is reversed there is no difference in the flight characteristics of the kite, only differences in orientation.

When the handles are arranged in the order initially specified above, if the flyer tilts the tops of the handles away from the kite, the front of the kite moves forward in the wind and the back of the kite moves backward in the wind; therefore, shedding wind off the back of the kite and creating a forward motion which is adjustable in speed depending on the amount of tilt. Pulling away from the kite with the bottom of the handles creates reverse flight. A position in the middle will control the kite to stop and hover.

The lateral movement and controlled lift provided by the present invention are the result of the first and second aileron panels which add an extra dimension of sail-area to the kite. The extra dimension results in lift angles other than the lift provided by the first and second main center sail panels. The additional lift can be advantageously utilized by advanced pilots under variable wind conditions and when performing difficult maneuvers. When used by novice pilots, the present kite limits any possible frustration by keeping the kite from falling-out of the air when over-controlled or fed incorrect controls.

When the kite is at a neutral point in the air (hovering), pulling the left hand back away from the kite causes the kite to slide (move) to its left by shedding wind off the right side of the kite. The reverse is true when you pull the right hand back. If the tops or bottoms of the control handles are tilted during this maneuver, i.e., the kite has either forward or reverse motion, the kite will not only slide but partially turn around the side which you pull back on. Pulling back to create a turning motion, when combined with twisting of the handles to create a spinning motion, creates very dynamic quick turns.

The control achieved by pulling back on one handle or the other is not present in prior four-line kites. The ailerons are responsible for such controlled maneuvering in the present invention. The ailerons also permit a variety of advantageous and advanced maneuvers beyond the basic control outlined above.

If the kite gets caught on the ground with its front nose down, a seemingly unrecoverable position, the kite can be rolled into launch position by entirely pulling either handle back. This exposes the aileron to the wind, and the aileron flips the kite over. This same technique can be used in very advanced flying techniques where the flyer uses quick jerks in either full forward or full reverse, to cause the kite to roll over the lines toward the flyer with its top side facing the wind. At this point the kite can be very slightly controlled to move back and forth in the sky at the same altitude. In order to unroll the kite either aileron is exposed to the wind by pulling back either handle which allows the aileron to unroll the kite. This advanced technique cannot be accomplished with any prior kites, be they two-line or four-line.

As a result of the mirror structure of the support structure 12, a flexible wing advanced control mechanism is possible. The flexible wing occurs as a result of the freedom of motion allowed between the two mirrored sections 14, 16 twisting the sail 10 along the axis of the cross bow 18. The twisting occurs between the main center sail panels 64, 66, which are connected to the second spars 28, 28' by tip attachments on the cross bow 18. The twisting results in a reactive airfoil that, depending on the amount of twist, sheds more or less wind off the front of one side of the kite and the back of the other side of the kite. This permits controlled spinning of the kite. Specifically, the speed and radius of the spin can be controlled.

The spiral motion is accomplished by twisting the kite. The wind supplies the force necessary to change the shape of the airfoil. The kite itself has a natural tendency to return to its neutral position due to the tension in the sail. If a flyer wishes to change the natural tendency of return to the neutral position, the flyer can run a tension line between two opposite tip attachments of the second spars 28, 28'. This will change the primary shape of the airfoil.

Due to the nature of the tensegrity system, the kite collapses with little effort. This is best done starting with the first end of either the first spars 24, 24' and removing either of the tip attachment 31 attached thereto. After the first tip attachment 31 is removed the tension in the system is relaxed and the remaining spars are easily removed.

The cross bow, 18, comes apart into a first section 106, a middle section 107, and a third section 108 to allow the kite's further breakdown. Specifically, the hold backs 52, 52' are respectively attached to the first and second sections 106, 108 adjacent the attachment of the first section 106 to the middle section 107 and the attachment of the second section 108 to the middle section 107. In addition to permitting breakdown and storage of the kite 1, the three part cross bow 18 permits the use of various middle sections 107 to alter the strength of the cross bow 18. That is, one middle section 107 can be replaced by heavier, lighter, stronger or weaker spars to adjust the wind range of the kite.

Due to the three-dimensional structure of the kite, the kite can be launched from almost any position. This is helpful for landings and crashes for it does not require the pilot to walk out to the kite and prepare it for relaunch.

Various embodiments can be created, while remaining within the spirit of the present invention. For example, a cross bow having less or virtually no bowing could be used. This could be achieved by manipulating the lengths of the tension lines. Additionally, the kite sail could be modified to eliminate the shape control mid-panels. This would be achieved by extending the outer sail edges of the center panel and the inside edges of the aileron panels until they meet. This alternate design would provide a basic airfoil. Further, the mid-panels could be redesigned as multiple shape mid-panels. This would smooth the transition between the center of the sail and the ailerons to the point where there are infinite mid-panels and a completely curved surface containing no angles.

Other changes are possible within the spirit of the present invention. For example, the area spanning between the two mirror sections 14, 16 could be decreased until the second 28, 28' spars become one. The flexible wing would be gone but the kite would still have the tension airfoil shaping.

The kite can also be modified in front to back proportion by changing the lengths of second spars 28, 28' and the sail and tensile network to match. With an increased length, the kite will have more surface area for greater lift. This creates a kite for flying in ultra-light winds. If the length is decreased the kite has less surface area, producing less lift and a kite capable of flying in very heavy winds without increased stress on the kite, or increased pull on the flyer.

Another embodiment of the kite is possible by placing the cross bow below the sail and second spars. Then a second sail, which has a flat shape, is positioned between the cross bow and the tip attachments on the back ends of second spars. The second sail provides extra lift through added sail area, and creates what is termed a natural jet; smoothing the air released at the rear of the kite for smoother and faster flight characteristics.

Specifically, the second sail includes a concave front edge, with first and second forward tips. The second sail also includes a substantially concave back edge with first and second rearward tips located at respective ends of the back edge. Additionally, the kite sail includes a pair of outward extending tips.

In use, each of the tips include reinforcements (as discussed above with regard to the preferred embodiment) for attachment to the support structure of the kite. The first and second forward tips are respectively secured to the hold backs, the first and second rearward tips are respectively secured to the back ends of the second spars, and the outwardly extending tips are secured to the first and second ends of the cross bow.

While preferred embodiments of the present invention have been shown and described, it will be understood that it is not intended to limit the disclosure, but rather it is intended to cover all modifications and alternate methods and apparatuses falling within the spirit and scope of the invention as defined in the appended claims or their equivalents.

What is claimed is:

1. A kite comprising:

a kite sail supported in the shape of an airfoil by a support structure;

said kite sail including a center section between first and second outwardly and upwardly extending aileron sections;

said center section having a front edge including first and second forwardly directed tips and a back edge including first and second backwardly directed tips.

2. The kite according to claim 1, wherein said first and second rearwardly directed tips are further apart than said first and second forwardly directed tips.

3. The kite according to claim 1, wherein said first and second aileron sections are supported by said support structure to extend outwardly and upwardly.

4. The kite according to claim 3, wherein said first and second aileron sections are supported by said support structure to extend forwardly.

5. The kite according to claim 1, wherein said support structure includes a laterally extending cross member having first and second ends, first and second substantially upwardly extending spars respectively adjacent said first and second ends of said cross member, and first and second substantially horizontally extending spars respectively adjacent said first and second ends of said cross member.

6. The kite according to claim 5, wherein said first horizontally extending spar includes first and second ends that are respectively secured to said first forwardly directed tip and said first backwardly directed tip, and said second horizontally extending spar includes first and second ends that are respectively secured to said second forwardly directed tip and said first backwardly directed tip.

7. The kite according to claim 6, wherein said first aileron section includes a first aileron tip and said second aileron sections includes a second aileron tip, and a first end of said first upwardly extending spar is secured to said first aileron tip and a first end of said second upwardly extending spar is secured to said second aileron tip.

8. The kite according to claim 1, wherein said kite sail further includes a first mid-section positioned between said center section and said first aileron section, and a second mid-section is positioned between said center section and said second aileron section.

9. The kite according to claim 1, wherein said first forwardly directed tip and said first backwardly directed tip are located where said center section, said first mid-section and said first aileron section meet, and said second forwardly directed tip and said second backwardly directed tip are located where said center section, said second mid-section and said second aileron section meet.

10. The kite according to claim 8, wherein said center section, said first and second mid-sections, and said first and second aileron sections are distinct panels.

11. The kite according to claim 8, where said first and second mid-sections have convex outer edges which meet to form top and bottom pointed sections.

12. The kite according to claim 1, wherein said first forwardly directed tip and said first backwardly directed tip are located where said center section meets said first aileron section, and said second forwardly directed tip and said second backwardly directed tip are located where said center section meets said second aileron section.

13. The kite according to claim 1, wherein said center section includes a concave forwardly face edge and a concave backwardly facing edge.

14. The kite according to claim 1, wherein said first and second aileron sections are substantially triangular.

15. A kite comprising:

a kite sail supported in the shape of an airfoil by a support structure;

said kite sail including a center section between first and second outwardly and upwardly extending aileron sections;

said support structure including a laterally extending cross member having first and second ends, and a plurality of spars secured to said cross member to create a dynamic support structure, wherein said support structure creates a freedom of motion between said first aileron section and said second aileron section resulting in a reactive airfoil.

16. The kite according to claim 15, wherein first and second upwardly extending spars are substantially perpendicular to said cross member.

17. The kite according to claim 15, wherein first and second horizontally extending spars are substantially perpendicular to said cross member.

18. The kite according to claim 15, wherein said cross member is bowed.

19. The kite according to claim 15, wherein said cross member, first and second upwardly extending spars, and first and second horizontally extending spars are connected by a series of tension lines to create tensile support structure.

20. The kite according to claim 15, wherein said cross bow includes a first section, a second section, and a selectively removable middle section between the first and second sections.

21. The kite according to claim 15, wherein said plurality of spars includes first and second substantially upwardly extending spars respectively adjacent said first and second ends of said cross member, and first and second substantially horizontally extending spars respectively adjacent said first and second ends of said cross member.

22. A kite comprising:

a kite sail supported in the shape of an airfoil by a support structure;

said kite sail including a center panel having a concave forwardly extending edge and a concave backwardly extending edge, first and second control mid-panels respectively secured to first and second lateral edges of said center panel, and first and second upwardly and outwardly extending aileron panels respectively secured said first and second mid-panels;

wherein a first forwardly directed tip and a second backwardly directed tip are located where said center panel, said first control mid-panel and said first aileron panel meet, and a second forwardly directed tip and a second backwardly directed tip are located where said center panel, said second control mid-panel and said second aileron panel meet;

said support structure including a laterally extending cross member having first and second ends, first and second substantially upwardly extending spars respectively adjacent said first and second ends of said cross member, and first and second horizontally extending spars respectively adjacent said first and second ends of said cross member;

wherein said first horizontally extending spar includes first and second ends that are respectively secured to said first forwardly extending tip and said first backwardly extending tip, and said second horizontally extending spar includes first and second ends that are respectively secured to said second forwardly extending tip and said first backwardly extending tip; and said first aileron panel includes a first aileron tip and said and second aileron panel includes a second aileron tip, where a first end of said first upwardly extending spar is secured to said first aileron tip and a first end of said second upwardly extending spar is secured to said second aileron tip to support said aileron panels in an outwardly and upwardly extending direction.

* * * * *